US011884447B2

(12) United States Patent
Nunnold et al.

(10) Patent No.: US 11,884,447 B2
(45) Date of Patent: Jan. 30, 2024

(54) CONTAINER SHOULDER RIB

(71) Applicant: AMCOR RIGID PACKAGING USA, LLC, Ann Arbor, MI (US)

(72) Inventors: Tyler M. Nunnold, Van Buren Township, MI (US); James Stelzer, South Lyon, MI (US); Jairaj Chetas Desai, West Lafayette, IN (US)

(73) Assignee: AMCOR RIGID PACKAGING USA, LLC, Ann Arbor, MI (US)

( * ) Notice: Subject to any disclaimer, the term of this patent is extended or adjusted under 35 U.S.C. 154(b) by 284 days.

(21) Appl. No.: 17/292,487

(22) PCT Filed: Nov. 14, 2018

(86) PCT No.: PCT/US2018/061059
§ 371 (c)(1),
(2) Date: May 10, 2021

(87) PCT Pub. No.: WO2020/101672
PCT Pub. Date: May 22, 2020

(65) Prior Publication Data

US 2022/0017256 A1 Jan. 20, 2022

(51) Int. Cl.
*B65D 1/02* (2006.01)

(52) U.S. Cl.
CPC .... *B65D 1/0223* (2013.01); *B65D 2501/0036* (2013.01)

(58) Field of Classification Search
CPC ..... B65D 1/0223; B65D 2501/0036; B65D 1/40; B65D 1/42; B65D 2501/0018; B65D 23/102
USPC ..... 215/383
See application file for complete search history.

(56) References Cited

U.S. PATENT DOCUMENTS

| | | | | |
|---|---|---|---|---|
| 8,496,130 | B2 | 7/2013 | Lane et al. | |
| 9,394,072 | B2 | 7/2016 | Patcheak et al. | |
| 2004/0074864 | A1 | 4/2004 | Melrose et al. | |
| 2007/0170144 | A1* | 7/2007 | Lane | B65D 1/0223 215/383 |
| 2015/0108081 | A1 | 4/2015 | Boulay et al. | |
| 2017/0073137 | A1 | 3/2017 | Maquita Nakano et al. | |

FOREIGN PATENT DOCUMENTS

WO WO-2013085919 A1 6/2013

OTHER PUBLICATIONS

International Search Report and Written Opinion of the ISA issued in PCT/US2018/061059, dated Aug. 6, 2019; ISA/KR.

* cited by examiner

*Primary Examiner* — Rafael A Ortiz
*Assistant Examiner* — Sanjidul Islam
(74) *Attorney, Agent, or Firm* — Harness, Dickey & Pierce, P.L.C.

(57) ABSTRACT

A polymeric container including a finish defining an opening of the container. A shoulder of the container is between the finish and a body of the container. A base of the container is at an end of the body opposite to the shoulder. The base is configured to support the container upright. A plurality of body ribs are at the body. A shoulder rib is between the shoulder and the body. The shoulder rib has a maximum height that is about 5 times greater than a maximum depth of the shoulder rib.

13 Claims, 13 Drawing Sheets

CONTAINER SHOULDER RIB

CROSS-REFERENCE TO RELATED APPLICATION

This application is a U.S. National Phase Application under 35 U.S.C. 371 of International Application No. PCT/US2018/061059, filed on Nov. 14, 2018. The entire disclosure of the above application is incorporated herein by reference.

FIELD

The present disclosure relates to a polymeric container including a shoulder rib that transfers top load force to body ribs of the container.

BACKGROUND

This section provides background information related to the present disclosure, which is not necessarily prior art.

As a result of environmental and other concerns, plastic containers, more specifically polyester and even more specifically polyethylene terephthalate (PET) containers, are now being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container.

$$\%\ \text{Crystallinity} = \left(\frac{\rho - \rho_a}{\rho_c - \rho_a}\right) \times 100$$

The following equation defines the percentage of crystallinity as a volume fraction: where $\rho$ is the density of the PET material; $\rho_a$ is the density of pure amorphous PET material (1.333 g/cc); and $\rho_c$ is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching an injection molded PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 250° F.-350° F. (approximately 121° C.-177° C.), and holding the blown container against the heated mold for approximately two (2) to five (5) seconds. Manufacturers of PET juice bottles, which must be hot-filled at approximately 185° F. (85° C.), currently use heat setting to produce PET bottles having an overall crystallinity in the range of approximately 25%-35%.

PET bottles must withstand the compressive forces incurred during handling, transportation, and storage as well as have sufficient strength to tolerate the capping process. One way to quantify the design and quality of containers is measuring resistance to top-loading. Top-load testing—also known as "crush testing" or "compressive strength testing"—evaluates a packaging material's structural resistance to a compressive load, to the point of deformation or collapse. Top-load testing is used to ensure packaging integrity, and to eliminate material excess while maintaining quality—a process known "light-weighting."

While current polymeric containers are suitable for their intended use, they are subject to improvement. For example, many PET bottles include stiffening ribs that perform well to resist ovalization caused by internal vacuum forces, but existing stiffening ribs tend to buckle and ovalize under top load. Vacuum absorbing ribs also work well to absorb internal vacuum forces, but they are too flexible and often ovalize under top load when used in the shoulder location. FIGS. 1A, 1B, 2A and 2B illustrate exemplary prior art PET containers 10A and 10B respectively, which experiences these issues.

As illustrated in FIG. 1A, the prior art container 10A includes a finish 12A, which defines an opening 14A of the container 10A. The longitudinal axis A extends through an axial center of the opening 14A. The finish 12A includes threads 16A, which are configured to cooperate with corresponding threads of any suitable closure for closing the opening 14A. The finish 12A extends to a neck 20A. Between the neck 20A and the finish 12A is a flange 22A.

The neck 20A extends to a shoulder 30A. As the shoulder 30A extends from the neck 20A, the shoulder 30A expands outward and away from the longitudinal axis A. The shoulder 30A thus tapers outward as it extends to a body 40A of the container 10A. The body 40A extends down to a base 50A of the container 10A. The base 50A is configured to support the container 10A upright on any suitable standing surface. The shoulder 30A, the body 40A, and the base 50A define an internal volume 52A of the container 10A. Any suitable product may be stored within the internal volume 52A, such as any suitable hot-fill product.

The shoulder 30A may define one or more indents 32A, which may be spaced apart about the shoulder 30A. The indents 32A may be recesses within the shoulder 30A such that at the indents 32A the shoulder 30A has a relatively smaller maximum diameter as compared to portions of the shoulder 30A between the indents 32A. The indents 32A may be of any suitable shape and/or size.

With continued reference to FIG. 1A and additional reference to FIG. 1B, the container 10A includes a shoulder rib 60A between the shoulder 30A and the body 40A. The shoulder rib 60A is defined by a sidewall 88A of the container 10A, and includes a lower radius 62A, an upper radius 64A, and a center radius 66A. The lower radius 62A extends to the body 40A, the upper radius 64A extends to the shoulder 30A, and the center radius 66A is between the lower radius 62A and the upper radius 64A.

The shoulder rib 60A has a maximum height $H_A$, which extends from where the lower radius 62A transitions to the body 40A to where the upper radius 64A transitions to the shoulder 30A. The upper radius 64A extends to a portion of the shoulder 30A not including one of the indents 32A. Upper radius 64A' extends to the one or more portions of the shoulder 30A including the indent(s) 32A.

With continued reference to FIG. 1B, the shoulder rib 60A further includes a lower depth $LD_A$ and an upper depth $UD_A$. The lower depth $LD_A$ is measured between an outermost portion of the body 40A where the body 40A meets the lower radius 62A, and the center portion 66A of the shoulder rib 60A. Upper depth $UD_A$ is measured from a maximum diameter of the shoulder 30A where the shoulder 30A meets the upper radius 64A, and the center portion 66A. The upper depth $UD_A$ and the lower depth $LD_A$ are about the same. Upper depth $UD_A'$ is measured between a maximum diameter portion of any one of the indents 32A, and the center portion 66A. The height $H_A$ is about 2 times greater than the lower depth $LD_A$ and the upper depth $UD_A$. The height $H_A$ is 4 times greater than the upper depth $UD_A'$ at the indents 32A.

The container 10A further includes a center body rib 80A at a general midpoint along the height of the body 40A, and generally at a portion of the body 4A having the smallest diameter thereof. Thus, the body 40A generally has an hourglass shape. Above the center body rib 80A are a plurality of upper body ribs 82A. Below the center body rib 80A are a plurality of lower body ribs 86A. Between the lower body ribs 86A and the base 50A is a base rib 84A. Each one of the ribs 60A, 80A, 82A, 84A, and 86A are defined by a sidewall 88A of the container 10A.

The prior art container 10B of FIG. 2 is substantially similar to the prior art container 10A of the FIGS. 1A and 1B. Therefore, the features of the container 10B are designated in FIG. 2 using the same reference numerals as FIGS. 1A and 1B, except that the suffix "A" is replaced with the suffix "B." The only substantial difference between the container 10A and the container 10B is at the shoulder rib 60B. Unlike the shoulder rib 60A, the shoulder rib 60B has an overall height $H_B$ that is about 1.25 times greater than the lower depth $LD_B$ and the upper depth $UD_C$, and about 5 times greater than the upper depth $UD_C'$ at the indents 32A. As explained herein in the discussion of the test results illustrated in FIGS. 6A and 6B, the prior art containers 10A and 10B may be capable of resisting ovalization caused by internal vacuum forces (such as during a hot-fill), but the containers 10A and 10B tend to buckle and ovalize under top-load.

The present disclosure advantageously provides for container ribs that solve the issues experienced in the prior art by allowing top load forces to be transferred from the shoulder to the body of the container without the ribs compressing or being too rigid. The top load forces are then absorbed by ribs of the container body. The present disclosure provides numerous additional advantages and unexpected results, as explained in detail herein and as one skilled in the art will recognize.

SUMMARY

This section provides a general summary of the disclosure, and is not a comprehensive disclosure of its full scope or all of its features.

A polymeric container including a finish defining an opening of the container. A shoulder of the container is between the finish and a body of the container. A base of the container is at an end of the body opposite to the shoulder. The base is configured to support the container upright. A plurality of body ribs are at the body. A shoulder rib is between the shoulder and the body. The shoulder rib has a maximum height that is about 5 times greater than a maximum depth of the shoulder rib.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of select embodiments and not all possible implementations, and are not intended to limit the scope of the present disclosure.

Corresponding reference numerals indicate corresponding parts throughout the several views of the drawings.

DETAILED DESCRIPTION

Figure 1A:
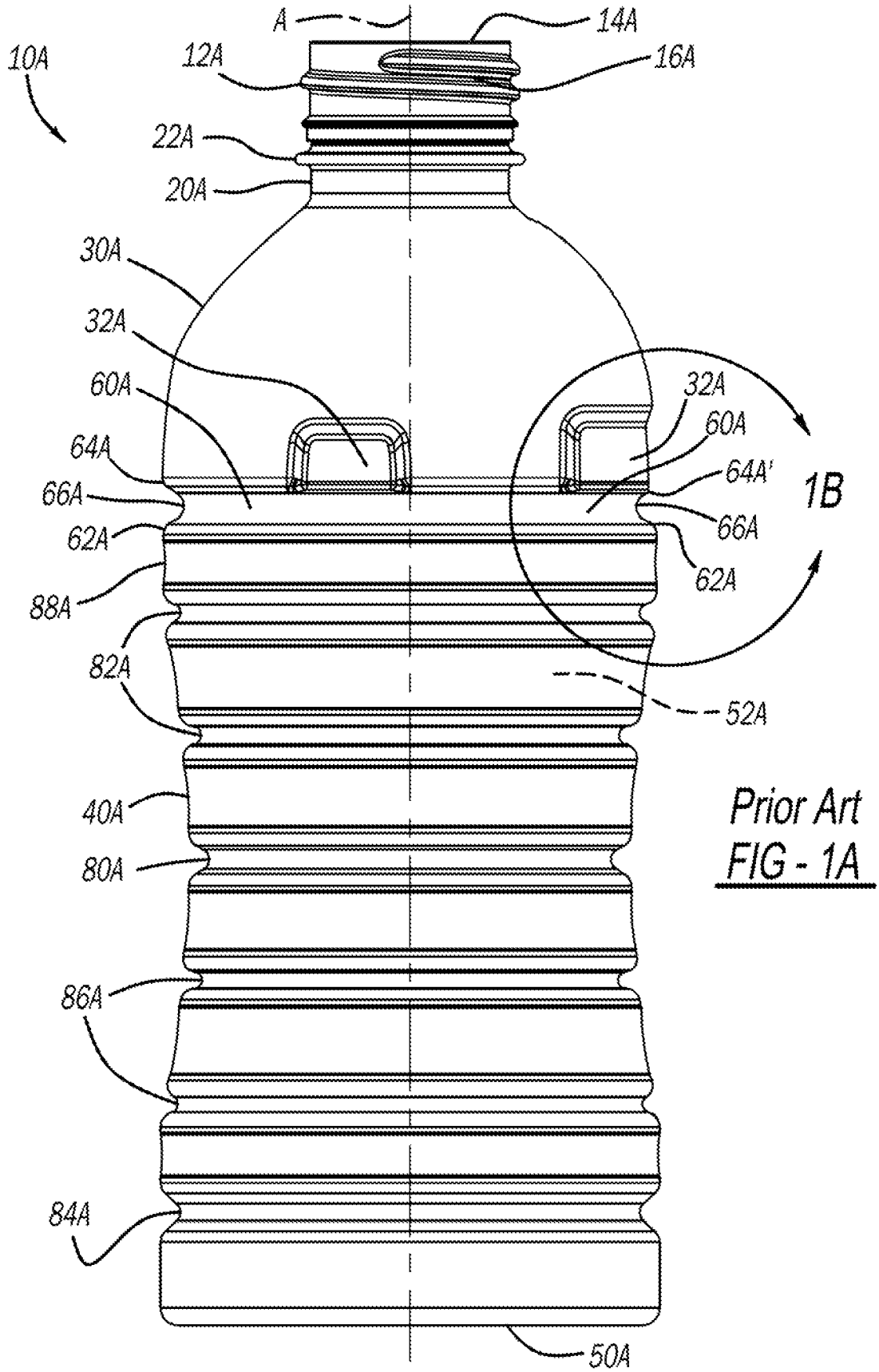
Prior Art FIG - 1A
FIG. 1A illustrates a first prior art container.
Figure 1B:
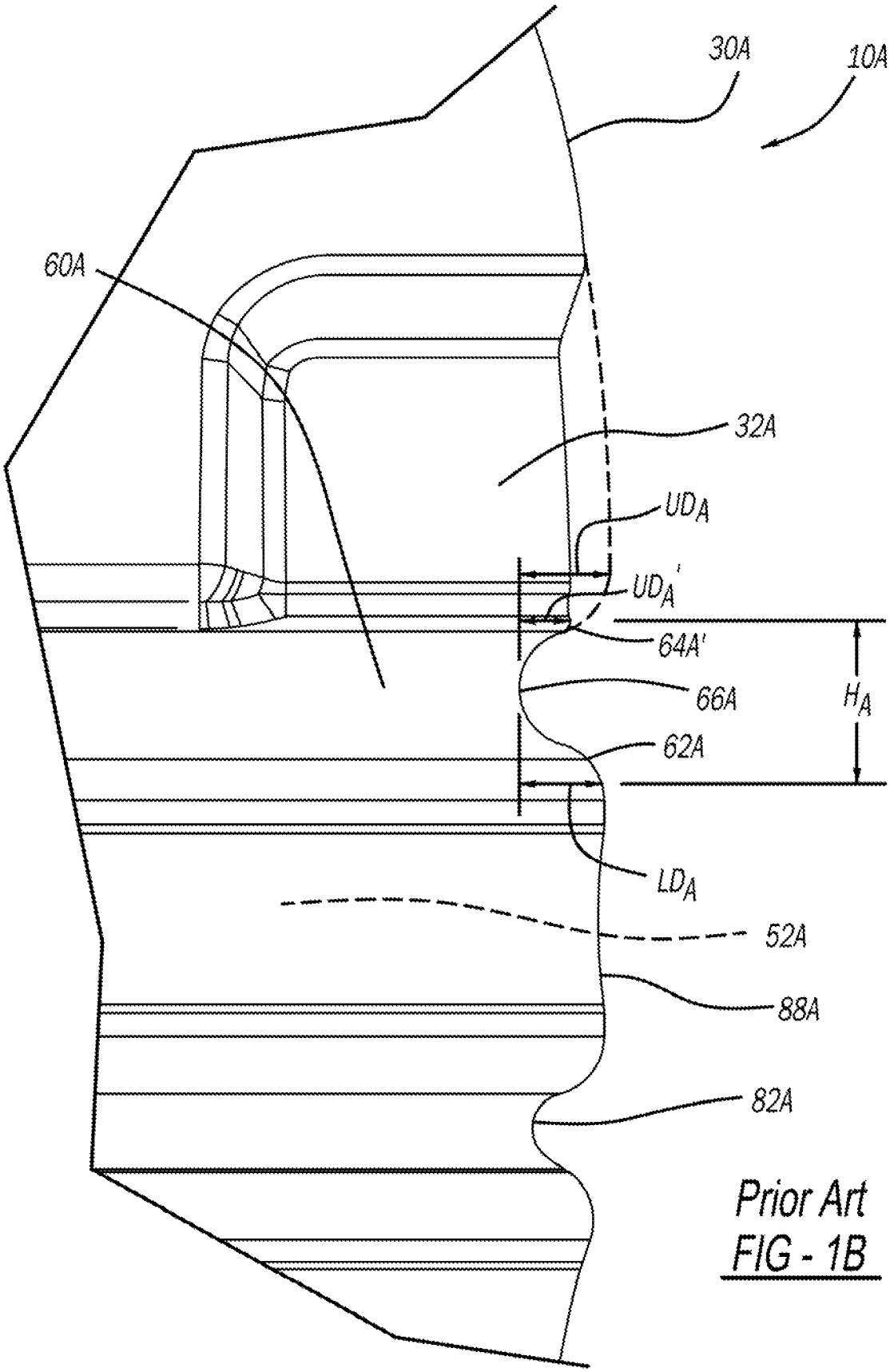
Prior Art FIG - 1B
FIG. 1B illustrates area 1B of FIG. 1A.
Figure 2A:
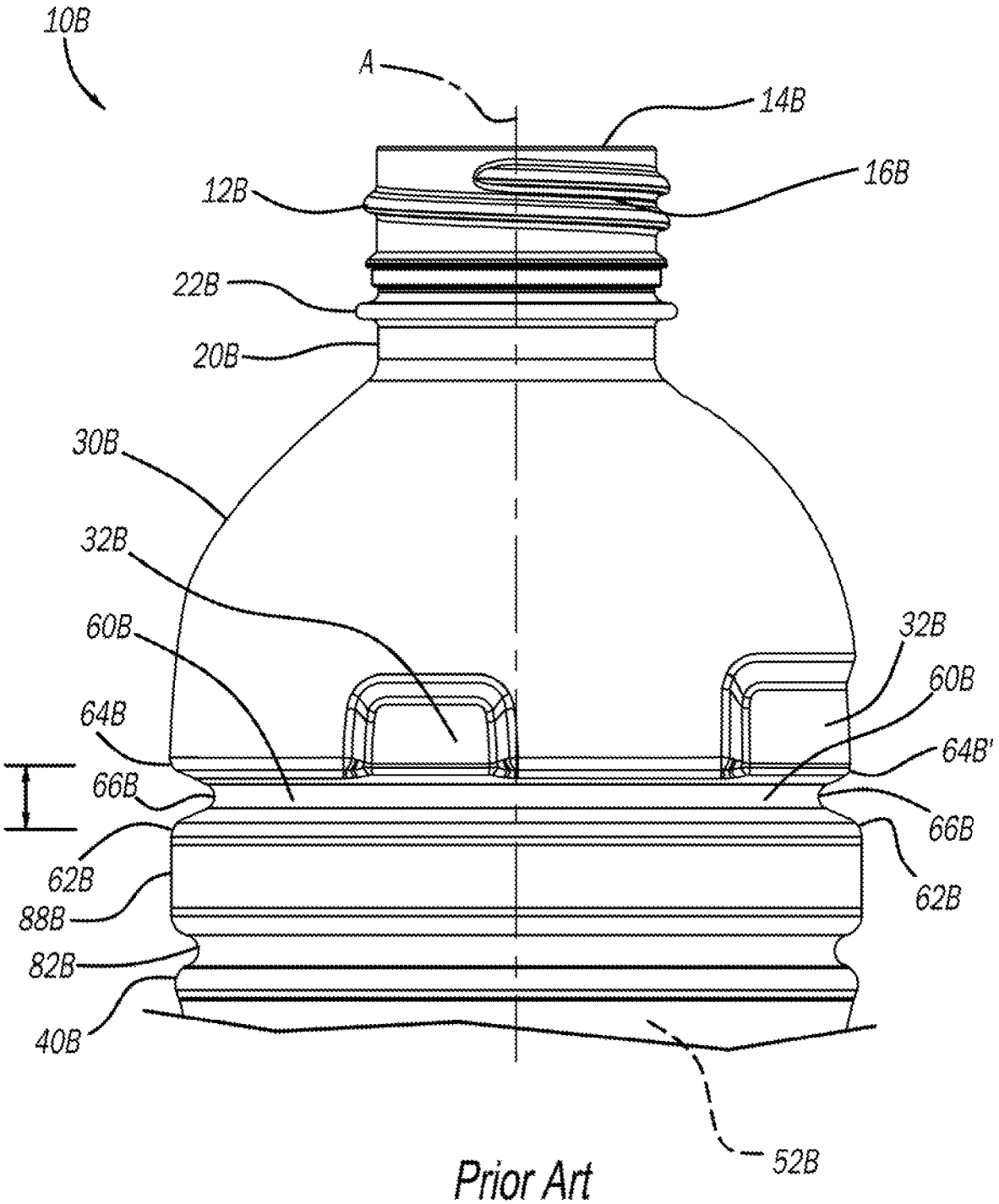
Prior Art FIG - 2A
FIG. 2A illustrates a second prior art container.
Figure 2B:
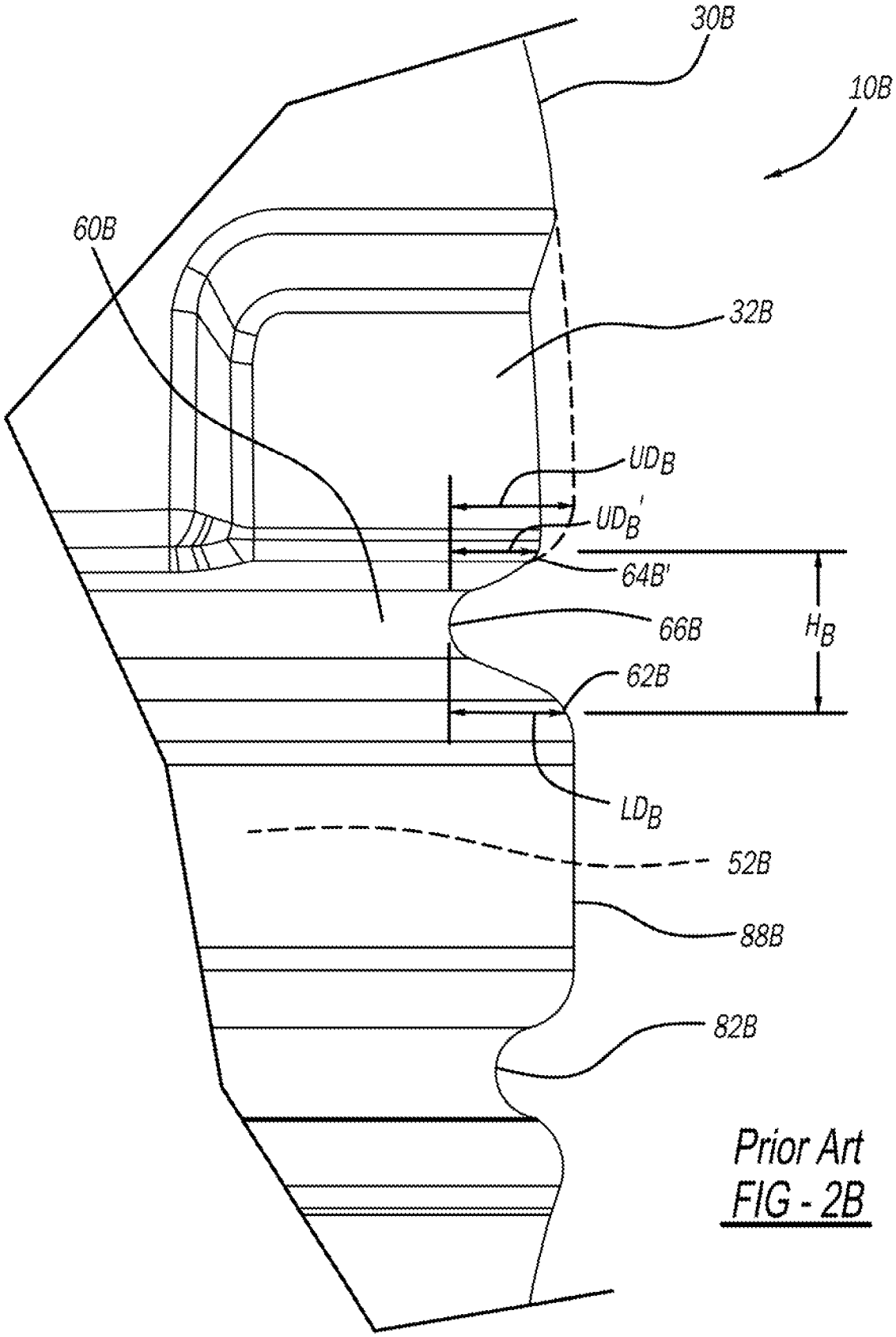
Prior Art FIG - 2B
FIG. 2B illustrates area 2B of FIG. 2A.

Example embodiments will now be described more fully with reference to the accompanying drawings.

With reference to FIGS. 3A, 3B, 3C, and 3D, a first container in accordance with the present disclosure is illustrated at reference numeral 10C. The container 10C may be made of any suitable material, such as any suitable polymeric material including polyethylene terephthalate (PET). The container 10C is configured to store any suitable material therein, such as any suitable hot-fill commodity. The container 10C (as well as container 10D of FIGS. 4A and 4B, and container 10E of FIGS. 5A and 5B) has some features that are similar to the prior art containers 10A and 10B. Features of the containers 10C, 10D, and 10E that are similar to features of the containers 10A and 10B are illustrated with the same reference numbers, but with the suffixes "C," "D," and "E" respectively instead of "A" or "B." With respect to such similar features, the description set forth above with respect to containers 10A and 10B also applies to the similar features of containers 10C, 10D, and 10E. Differences between the containers 10C, 10D, and 10E and prior art containers, such as containers 10A and 10B, are explained below.

The container 10C may be of any suitable size, such as 32 oz. When empty, the container 10C may have a weight of about 39 grams, which is advantageously less than many prior containers, such as the containers 10A and 10B. The specific configuration of the shoulder 30C and the shoulder rib 60C described herein advantageously allows the thickness of the sidewall 88C of the container 10C to be reduced, which decreases the overall weight of the container 10C. For example, the thickness of the sidewall 88C may be about 0.014". The configuration of the shoulder 30C and shoulder 60C of the container 10C also prevents the container 10C from ovalizing when a top force is applied to the container 10C after it has been filled and capped.

The shoulder rib 60C is an uppermost rib of the container 10C, and is located adjacent to, and between, the shoulder 30C and the body 40C. The shoulder rib 60C is located above a center of gravity of the container 10C, such as about 133 mm. from the base 50C. More generally, the shoulder rib 60C is located at a top half of the container 10C. The center body rib 80C, the upper body ribs 82C, and the lower body ribs 86C may be any suitable active hinge ribs, such as set forth in U.S. Pat. No. 8,496,130, which is incorporated herein by reference. The base 50C may be any suitable base, such as any one of the bases disclosed at U.S. Pat. No. 9,394,072, which is incorporated herein by reference.

Figure 3A:
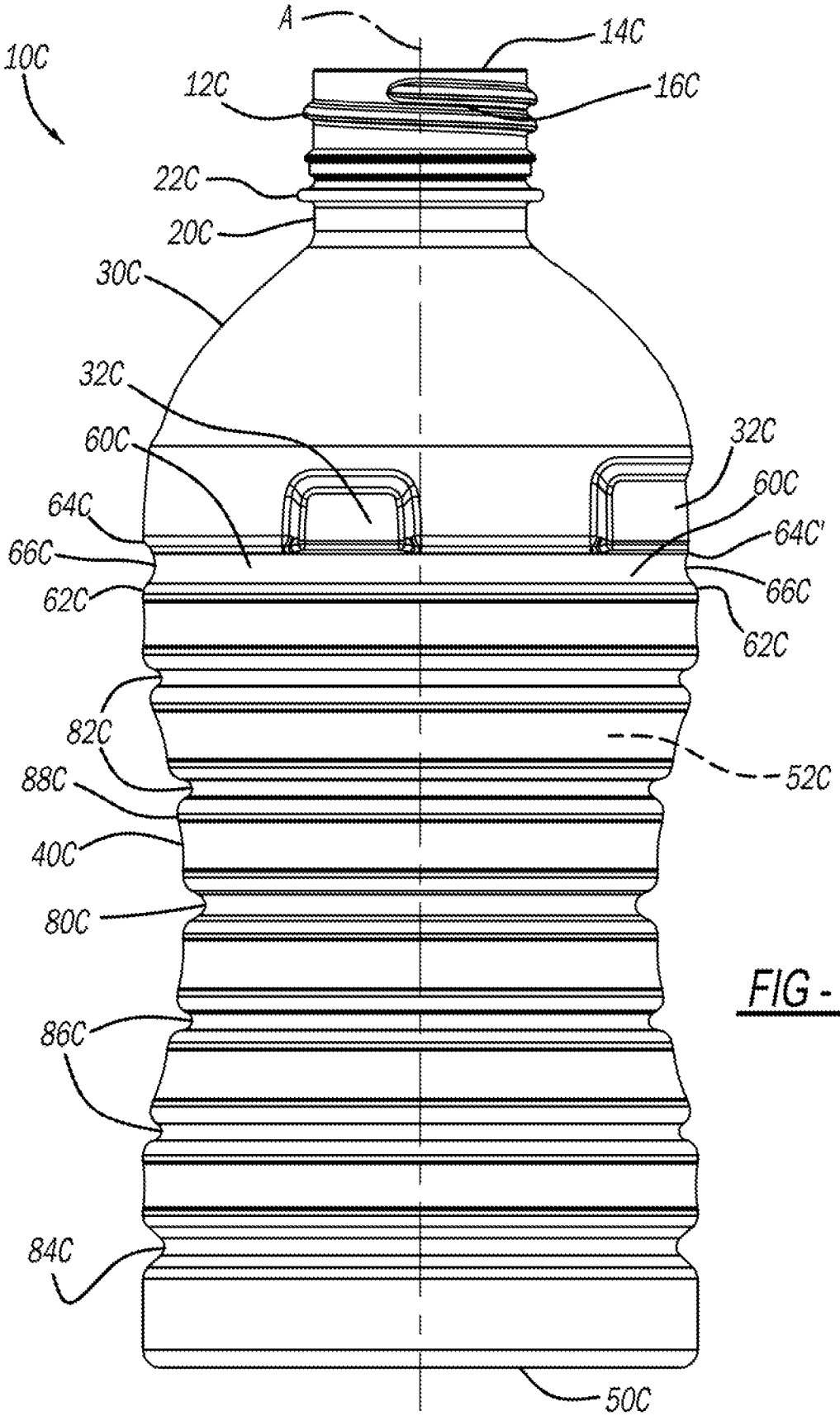
FIG. 3A illustrates a first container in accordance with the present disclosure.
Figure 3B:
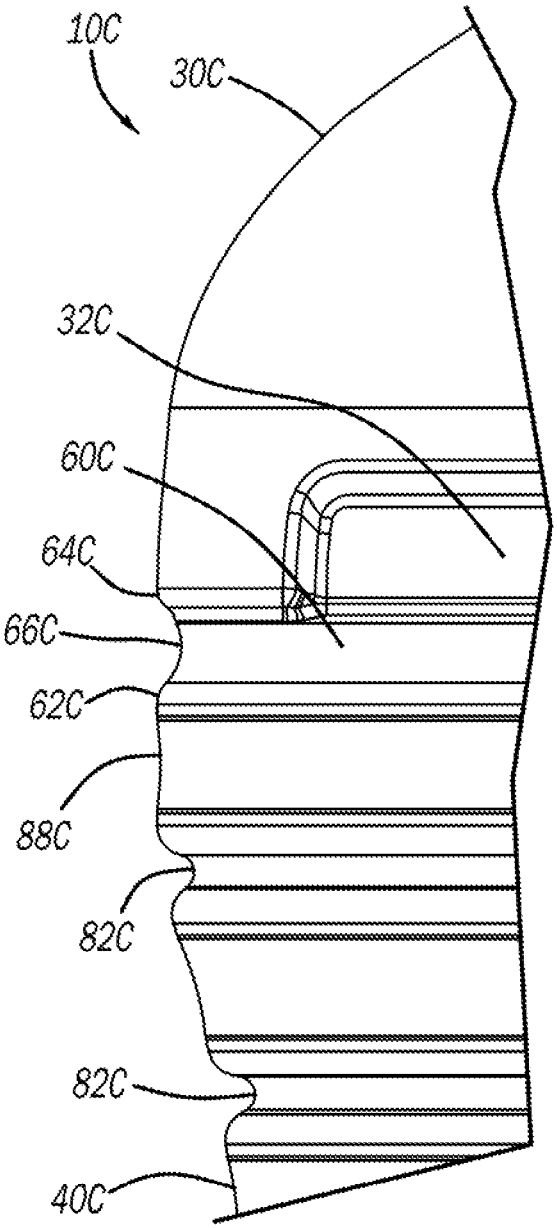
FIG. 3B illustrates a first portion of a sidewall of the first container of FIG. 3A.
Figure 3C:
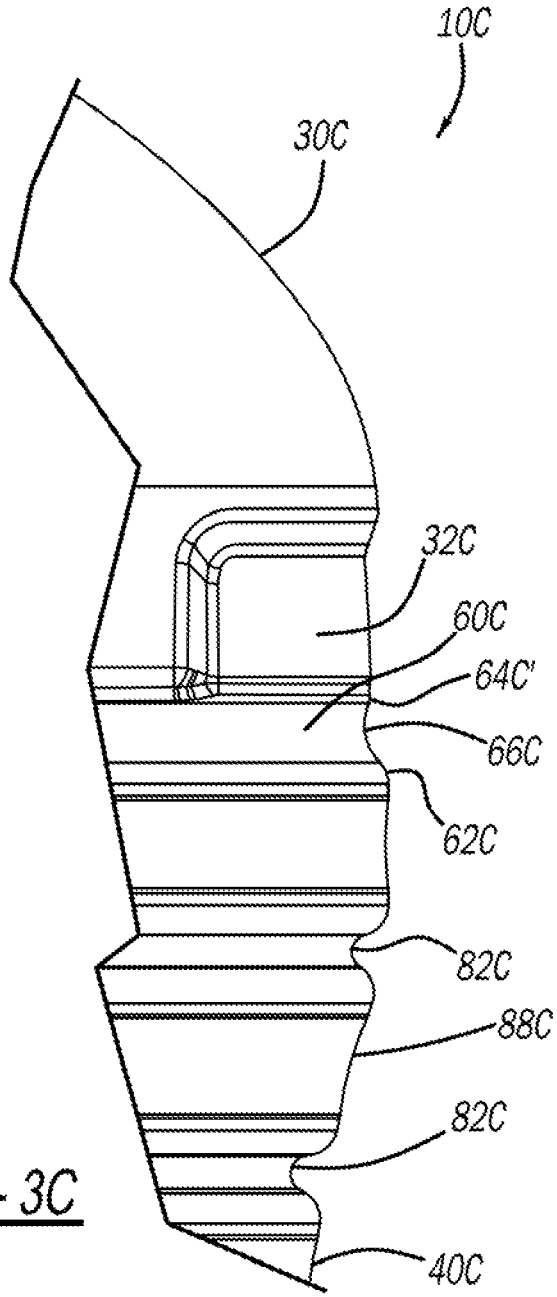
FIG. 3C illustrates a second portion of the sidewall of the first container of FIG. 3A.
Figure 3D:
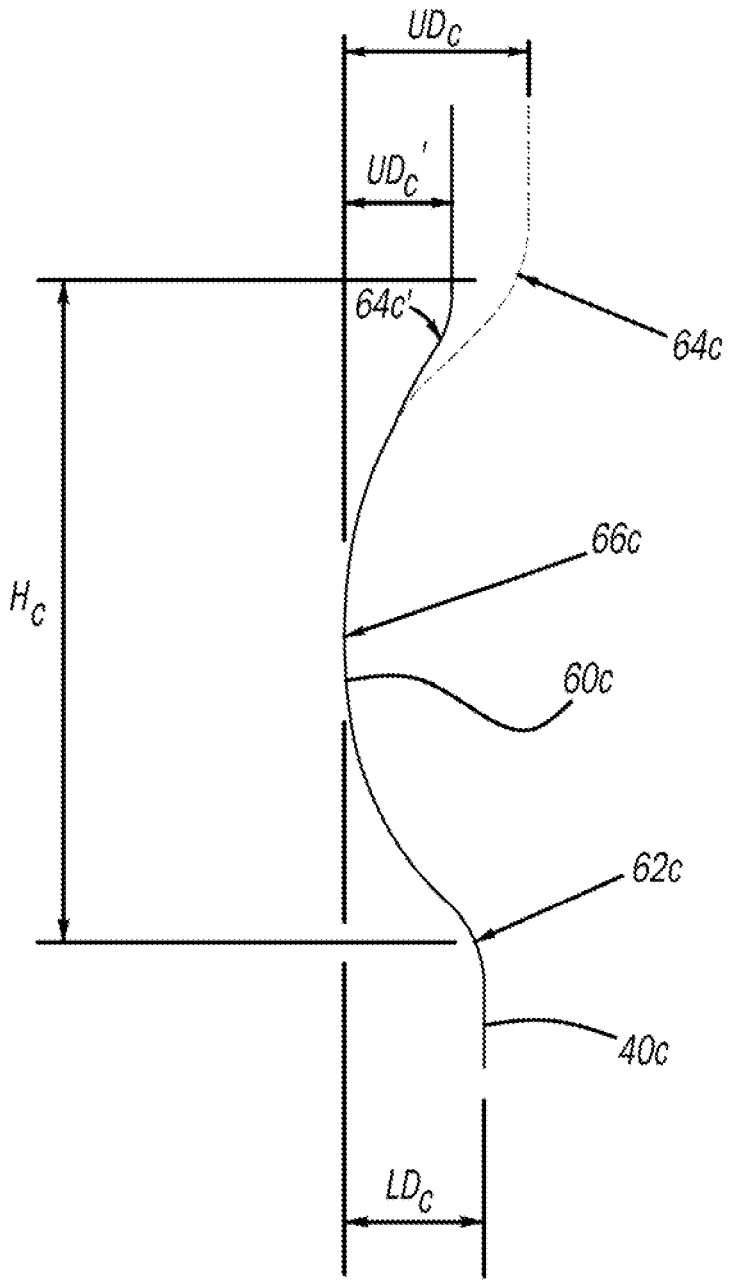
FIG. 3D illustrates a shoulder rib of the first container of FIG. 3A.

Unlike the containers 10A and 10B, shoulder rib 60C of the container 10C has a height $H_C$ that is about 5 times greater than the lower depth $LD_C$ and the upper depth $UD_C$ (see FIG. 3D, for example). The height $H_C$ is measured from where the lower radius 62C meets the body 40C, to where the upper radius 64C meets the shoulder 30C. The lower depth $LD_C$ is measured from the outermost portion of the body 40C proximate to where the lower radius 62C meets the body 40C, and the center portion of the center radius 66C, as illustrated in FIG. 3D. The upper depth $UD_C$ is measured from the maximum diameter of the shoulder 30C proximate to where the upper radius 64C meets the shoulder 30C, and the center of the radius 66C. The upper depth $UD_C'$ is measured from where the upper radius 64C meets the maximum diameter of the shoulder 30C at any one of the indents 32C, and the center portion of the center radius 66C, as illustrated in FIG. 3D.

The shoulder rib 60C is continuously curved overall across the lower radius 62C, the upper radius 64C, and the center radius 66C. The center radius 66C has a radius of curvature of about 4.44 mm. The lower radius 62C and the upper radius 64C may be any suitable radii, such as a radii of about 2-2.5 mm.

In one example, the height $H_C$ is about 9.5 mm, and each one of the lower depth $LD_C$ and the upper depth $UD_C$ is about 2 mm. At any one of the indents 32C, the effective upper depth $UD_C'$ is less than the upper depth $UD_C$. Thus, the upper depth $UD_C'$ at the indent 32C can be about 70-80% less than the lower depth $LD_C$ and the height $H_C$ is about 19 times greater than the upper depth $UD_C$. For example, the upper depth $UD_C'$ at the indent 32C can be about 0.5 mm, and the lower depth $LD_C$ can be about 2 mm. Thus at the upper radius 64C' the shoulder rib 60C has a maximum diameter that is less than a maximum diameter of the lower radius 62C. The variable depth of the shoulder rib 60C is the result of different container diameters above and below the shoulder rib 60C.

Figure 4A:
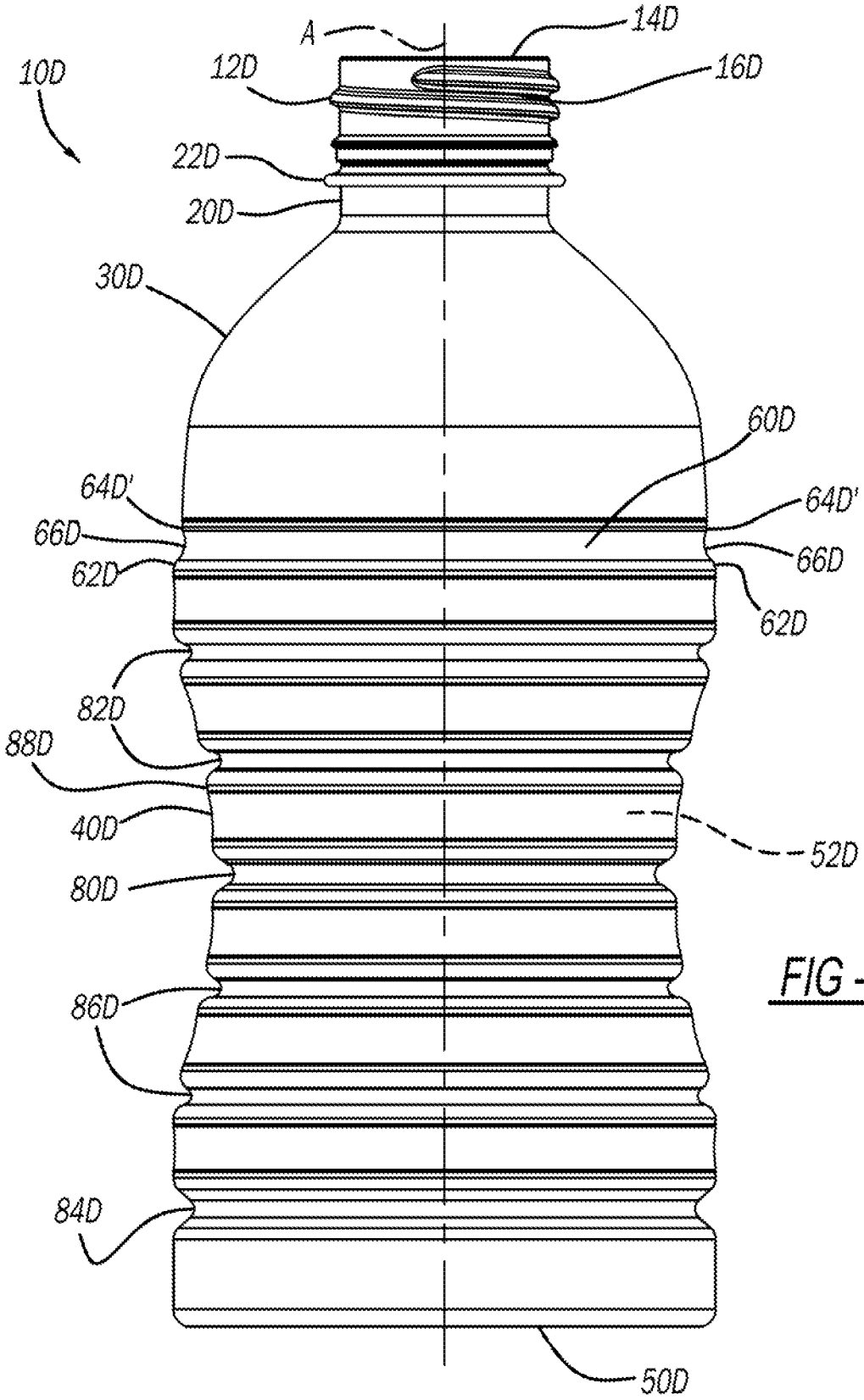
FIG. 4A illustrates a second container in accordance with the present disclosure.
Figure 4B:
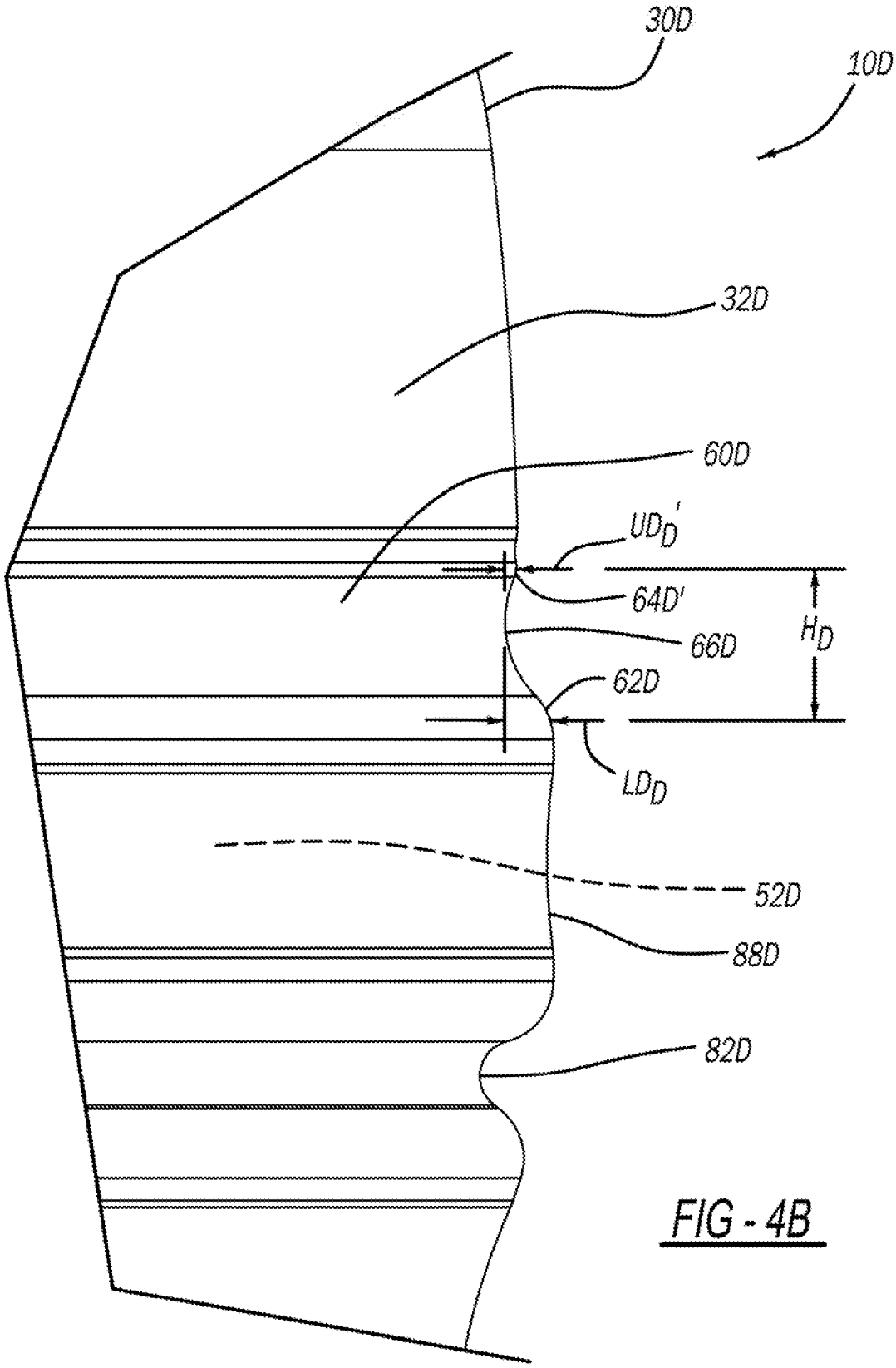
FIG. 4B illustrates area 4B of FIG. 4A.

With reference to FIGS. 4A and 4B, the present disclosure further includes the container 10D with a shoulder rib 60D. Like the shoulder ribs 60C and 60E, the shoulder rib 60D has a height $H_D$ that is about 5 times greater than lower depth $LD_D$ and upper depth $UD_D$. Unlike the shoulder ribs 60C and 60E, the reduced upper diameter $UD_D'$ is present about an entire circumference of the shoulder 30A.

Figure 5A:
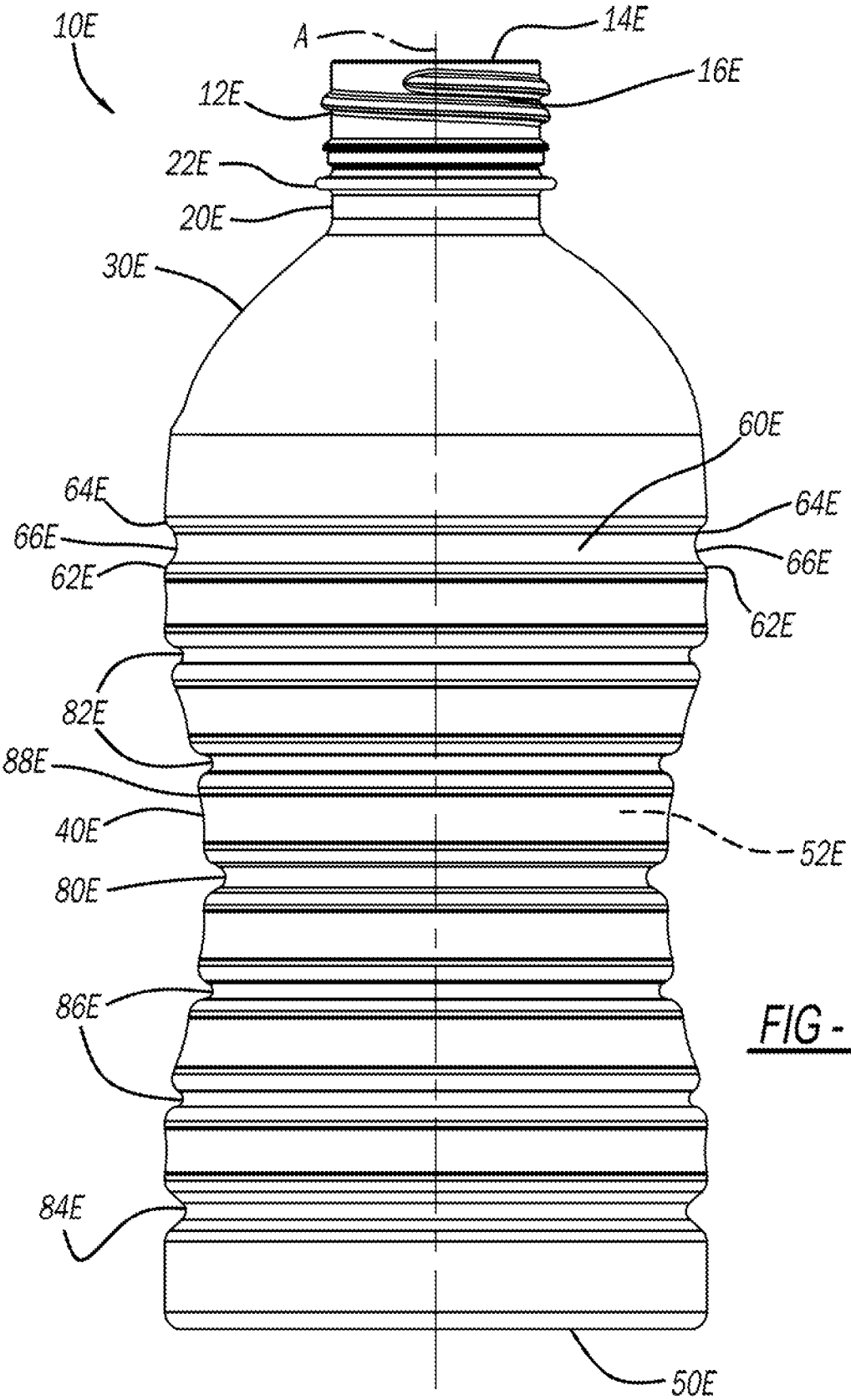
FIG. 5A illustrates a third container in accordance with the present disclosure.
Figure 5B:
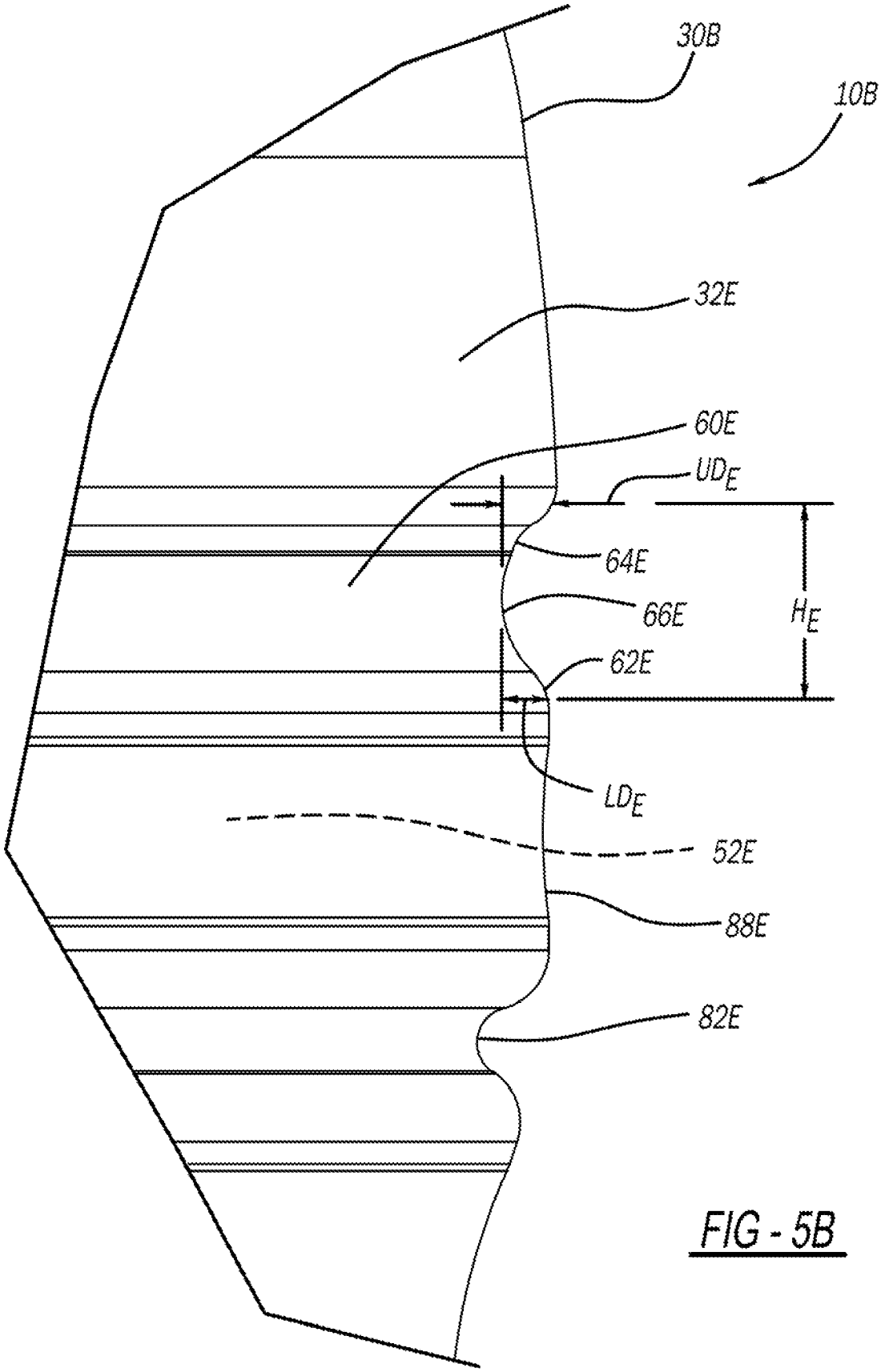
FIG. 5B illustrates area 5B of FIG. 5A.

With reference to FIGS. 5A and 5B, the present disclosure further includes the container 10E with a shoulder rib 60E. Like the shoulder ribs 60C and 60D, the shoulder rib 60E has a height $H_E$ that is about 5 times greater than lower depth $LD_E$ and upper depth $UD_E$. Unlike the shoulder ribs 60C and 60D, however, the upper depth $UD_E$ of the shoulder rib 60E is the same as the lower depth $LD_E$ about the entire circumference of the shoulder rib 60E.

Figure 6A:
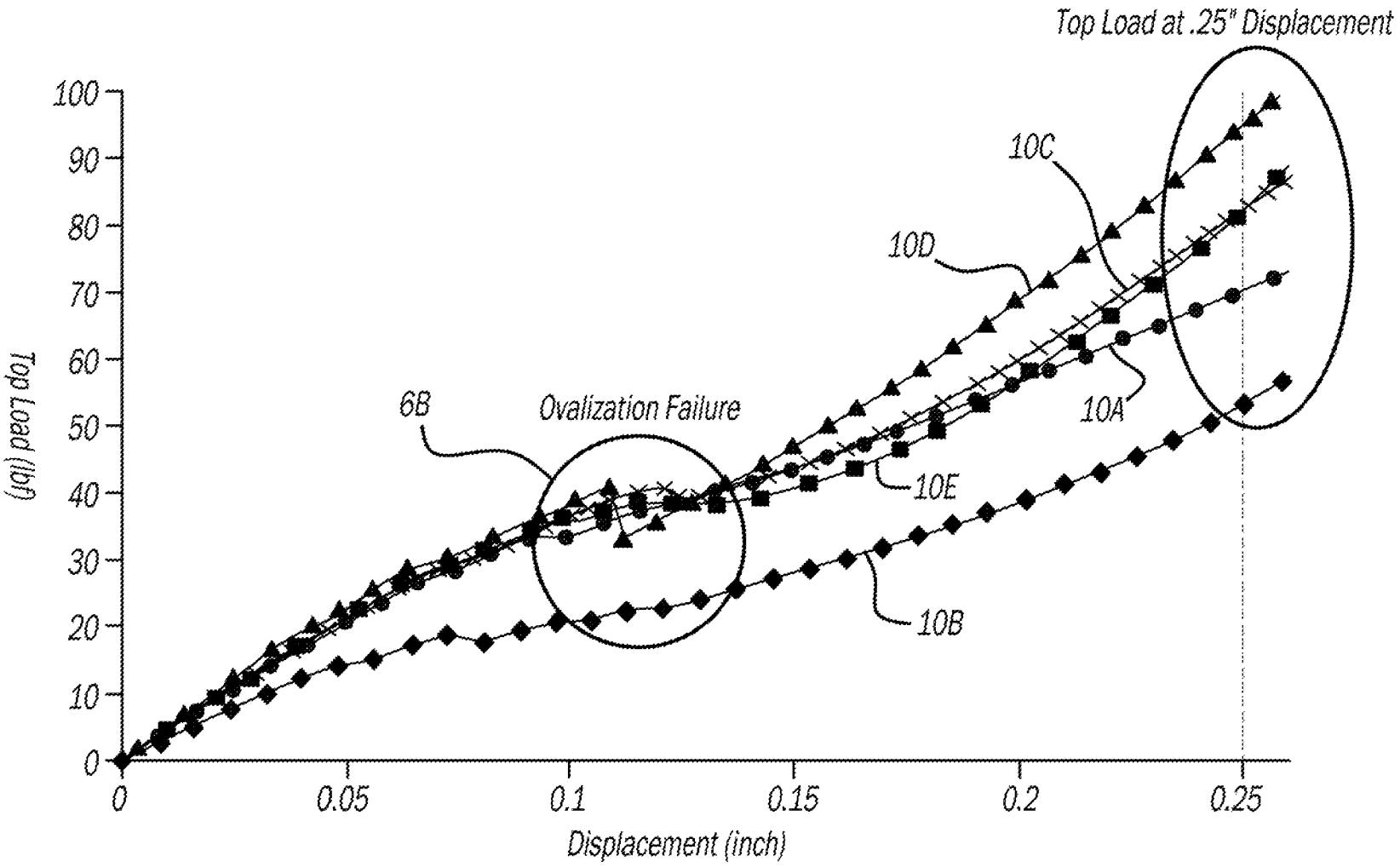
FIG. 6A illustrates filled, capped, top load performance of the containers of FIGS. 1-5.
Figure 6B:
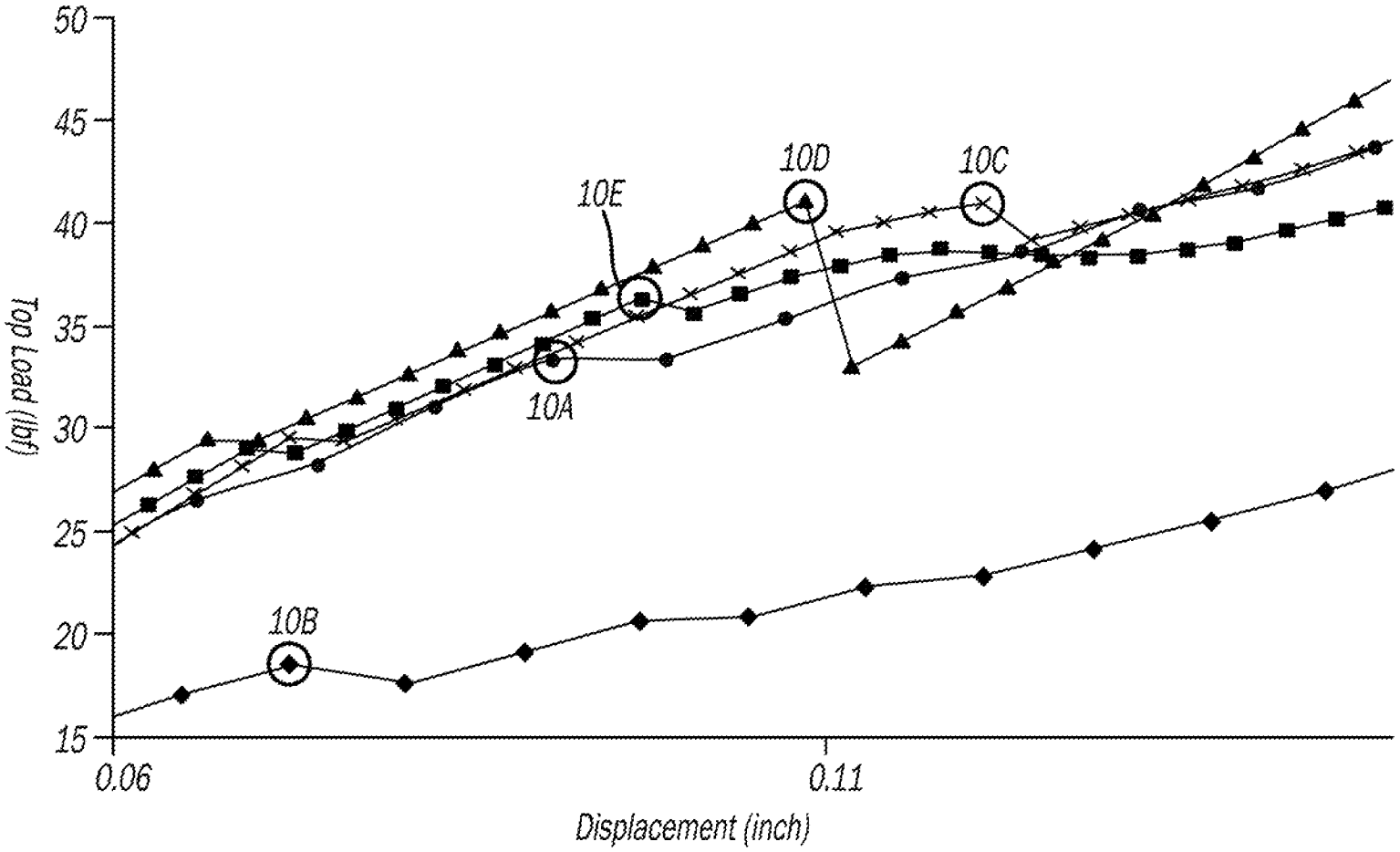
FIG. 6B illustrates the detail at area 6B of FIG. 6A.

With reference to FIGS. 6A and 6B, filled capped top load performance for each one of the containers 10A, 10B, 10C, 10D, and 10E is illustrated. With particular reference to FIG. 6B, testing shows that containers 10C, 10D, and 10E exhibit superior top load performance as compared to prior art containers 10A and 10B. Specifically, prior art containers 10A and 10B experience ovalization failure at a lower top load as compared to containers 10C, 10D, and 10E.

With particular reference to FIG. 6B, container 10D is able to withstand the greatest amount of top load force before experiencing an ovalization failure. Although container 10C is not able to withstand as much top load force as container 10D, container 10C exhibits less displacement than all of the other containers. Container 10E, which has a shoulder rib 60E without a variable depth, still exhibits superior top load performance as compared to prior art containers 10A and 10B, such as due to the shoulder rib 60E having a height $H_E$ that is about five times greater than the lower depth $LD_E$ and the upper depth $UD_E$. Advantageously, the top load strength of the containers 10C, 10D, and 10E increases as the perimeter length of the variable rib depth portion increases. With additional reference to FIG. 6A, top load is typically measured at a standard vertical displacement of 0.25", and all containers must meet a minimum top load requirement at that distance. Higher performance at 0.25" indicates a more rigid and robust container design.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise.

The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A polymeric container comprising:

a finish defining an opening of the container;

a shoulder between the finish and a body of the container;

a base at an end of the body opposite to the shoulder, the base configured to support the container upright;

a plurality of body ribs at the body; and a shoulder rib between the shoulder and the body, the shoulder rib has a maximum height that is about 5 times greater than a maximum depth of the shoulder rib, the shoulder rib is continuously curved along each of an upper radius, a lower radius, and a center radius between the upper radius and the lower radius, the upper radius extends to the shoulder, and the lower radius extends to the body; and a plurality of indentations spaced apart about the shoulder at the shoulder rib, an upper depth of the shoulder rib at the plurality of indentations is less than a lower depth of the shoulder rib.

2. The polymeric container of claim 1, wherein the shoulder rib is defined by a sidewall of the container.

3. The polymeric container of claim 1, wherein the maximum height is 9.5 mm and the maximum depth is 2 mm.

4. The polymeric container of claim 1, wherein the shoulder rib has a radius of about 4.44 mm.

5. The polymeric container of claim 1, wherein the upper radius is about 2.0 mm-2.5 mm and the lower radius is about 2.0 mm-2.5 mm.

6. The polymeric container of claim 1, wherein the shoulder rib is located above a center of gravity of the container.

7. The polymeric container of claim 1, wherein the shoulder rib is located at a top half of the container.

8. The polymeric container of claim 1, wherein the shoulder rib is about 133 mm from the base of the container.

9. The polymeric container of claim 1, wherein a maximum upper diameter of the container above the shoulder rib is less than a maximum lower diameter of the container below the shoulder rib.

10. The polymeric container of claim 9, wherein an upper depth of the shoulder rib is less than a lower depth of the shoulder rib.

11. The polymeric container of claim 10, wherein the upper depth of the shoulder rib is about 70%-80% less than the lower depth of the shoulder rib.

12. The polymeric container of claim 10, wherein the upper depth of the shoulder rib is about 0.5 mm and the lower depth is about 2 mm.

13. A polymeric container comprising:

a finish defining an opening of the container;

a shoulder between the finish and a body of the container, the body is tapered to give the body an hourglass shape;

a base at an end of the body opposite to the shoulder, the base configured to support the container upright;

a plurality of flexible body ribs at the body;

a shoulder rib between the shoulder and the body, the shoulder rib has a maximum height that is about 5 times greater than a maximum depth of the shoulder rib; and at least one indentation defined by the shoulder at the shoulder rib, an upper depth of the shoulder rib at the at least one indentation is less than a lower depth of the shoulder rib, wherein the upper depth is about 70%-80% less than the lower depth of the shoulder rib;

wherein the shoulder rib is defined by a sidewall of the container that continuously curves along a length of the shoulder rib, the shoulder rib includes an upper radius extending to the shoulder, a lower radius extending to the body, and a center radius between the upper radius and the lower radius.

* * * * *